US006431860B1

(12) United States Patent
Aono et al.

(10) Patent No.: US 6,431,860 B1
(45) Date of Patent: Aug. 13, 2002

(54) MATERIAL FEEDING MECHANISM IN ASSOCIATION WITH CONTINUOUS SINTERING APPARATUS

(75) Inventors: Shigenori Aono; Mitsuaki Kato; Hitoshi Kobayashi, all of Naka-gun (JP)

(73) Assignee: Japan Nuclear Cycle Development Institute, Ibaraki-ken (JP)

( * ) Notice: Subject to any disclaimer, the term of this patent is extended or adjusted under 35 U.S.C. 154(b) by 0 days.

(21) Appl. No.: 09/930,277

(22) Filed: Aug. 16, 2001

(51) Int. Cl.[7] ..... F27D 3/04; F27D 3/06

(52) U.S. Cl. ..... 432/126; 432/121; 432/239; 414/160; 414/176

(58) Field of Search ..... 432/52, 86, 87, 432/108, 121, 125, 126, 153, 239; 414/160, 172, 176, 187, 198, 586

(56) References Cited

U.S. PATENT DOCUMENTS 3,709,386 A * 1/1973 Jones ..... 214/23
4,421,481 A * 12/1983 Holz et al. ..... 432/126
5,482,661 A * 1/1996 Vismara ..... 264/413
6,257,879 B1 * 7/2001 Lu et al. ..... 432/126

* cited by examiner

*Primary Examiner*—Gregory Wilson
(74) *Attorney, Agent, or Firm*—Wenderoth, Lind & Ponack, L.L.P.

(57) ABSTRACT

In a material feeding mechanism in association with a continuous sintering apparatus, a material (S) carried by a transporting conveyer (1) into an atmosphere-displacement chamber (2) is fed into a furnace casing (4) of the continuous sintering apparatus by using a loading pusher (3). The transporting conveyor, the atmosphere-displacement chamber, and the loading pusher are arranged in such a manner that a direction in which the material is carried by the transporting conveyor and a direction in which the material is fed from the atmosphere-displacement chamber into the furnace casing by the loading pusher are linearly aligned, and the loading pusher and a drive unit thereof are installed under a floor of the atmosphere-displacement chamber so that the loading pusher moves up over the floor surface of the atmosphere-displacement chamber and moves forward and backward on the floor surface of the atmosphere-displacement chamber when the material is fed into the furnace casing. By such a construction, the longitudinal dimension of the continuous sintering apparatus can be made as short as possible to realize a compact design as a whole.

2 Claims, 4 Drawing Sheets

MATERIAL FEEDING MECHANISM IN ASSOCIATION WITH CONTINUOUS SINTERING APPARATUS

BACKGROUND OF THE INVENTION

The present invention relates to a material feeding mechanism for transporting or feeding materials or objects to be sintered to a continuous sintering furnace that is used for sintering fuel pellets, for example, in a process of manufacturing nuclear fuel.

When materials are fed or carried into a furnace casing of a continuous sintering apparatus, the inside of the furnace casing has to be kept at a constant atmosphere. Therefore, an atmosphere-displacement chamber is provided in front and in the rear of the furnace casing to perform evacuation of the atmosphere-displacement chamber and charging of the furnace atmosphere gas into the atmosphere-displacement chamber repetitively at the time of feeding and transporting the material.

In a prior art material feeding system, as shown in FIG. 5, a material S transported by a transporting conveyor 1 is carried into an atmosphere-displacement chamber 2 in a state where an entrance door 2*a* is opened and an exit door 2*b* is closed. Next, the entrance door 2*a* is closed and the atmosphere in the atmosphere-displacement chamber 2 is displaced or replaced by the furnace atmosphere, and then the exit door 2*b* of the atmosphere-displacement chamber 2 is opened, and a loading pusher 3 is driven in the direction perpendicular to the direction of transportation of the transporting conveyer 1 to feed the material S into a furnace casing 4 of a continuous sintering apparatus. The material S fed to the furnace casing 4 is placed at the predetermined location in the furnace casing by using a main pusher 5 provided in the furnace casing 4.

According to the prior art material feeding system shown in FIG. 5, since the feeding flow line of the material is cranked shape as shown by the arrow X, the longitudinal dimensions of the portions in front and in the rear of the furnace casing 4 have to be long enough. In addition, since a drive unit 3*a* for the loading pusher 3 have to be provided on the side of the atmosphere-displacement chamber, the space required for installing the material feeding mechanism becomes disadvantageously large.

SUMMARY OF THE INVENTION

It is an object of the present invention to provide a material feeding mechanism in association with the continuous sintering apparatus in which the longitudinal dimension of the continuous sintering apparatus can be made as short as possible to realize a compact design as a whole.

According to the present invention, there is provided a material feeding mechanism in association with a continuous sintering apparatus for feeding a material from an atmosphere-displacement chamber into a furnace casing of a continuous sintering apparatus by using a loading pusher, said material being carried by a transporting conveyer into said atmosphere-displacement chamber, characterized in that the transporting conveyor, the atmosphere-displacement chamber, and the loading pusher are arranged in such a manner that a direction in which the material is carried into the atmosphere-displacement chamber by the transporting conveyor and a direction in which the material is fed from the atmosphere-displacement chamber into the furnace casing by the loading pusher are linearly aligned, and the loading pusher and a drive unit thereof are installed under a floor of the atmosphere-displacement chamber so that the loading pusher moves up over a surface of the floor of the atmosphere-displacement chamber and moves forward and backward on the floor surface of the atmosphere-displacement chamber when the material is fed into the furnace casing.

The loading pusher in this case preferably comprises a chain pusher including a sprocket rotationally driven by a drive motor and disposed under the floor of the atmosphere-displacement chamber, a chain rotating via the sprocket, and a pusher head provided at the predetermined position on the chain, so that the pusher head moves up over the floor surface of the atmosphere-displacement chamber as the chain rotates, and moves forward and backward on the floor surface of the atmosphere-displacement chamber.

PREFERRED EMBODIMENTS OF THE INVENTION

Figure 1:
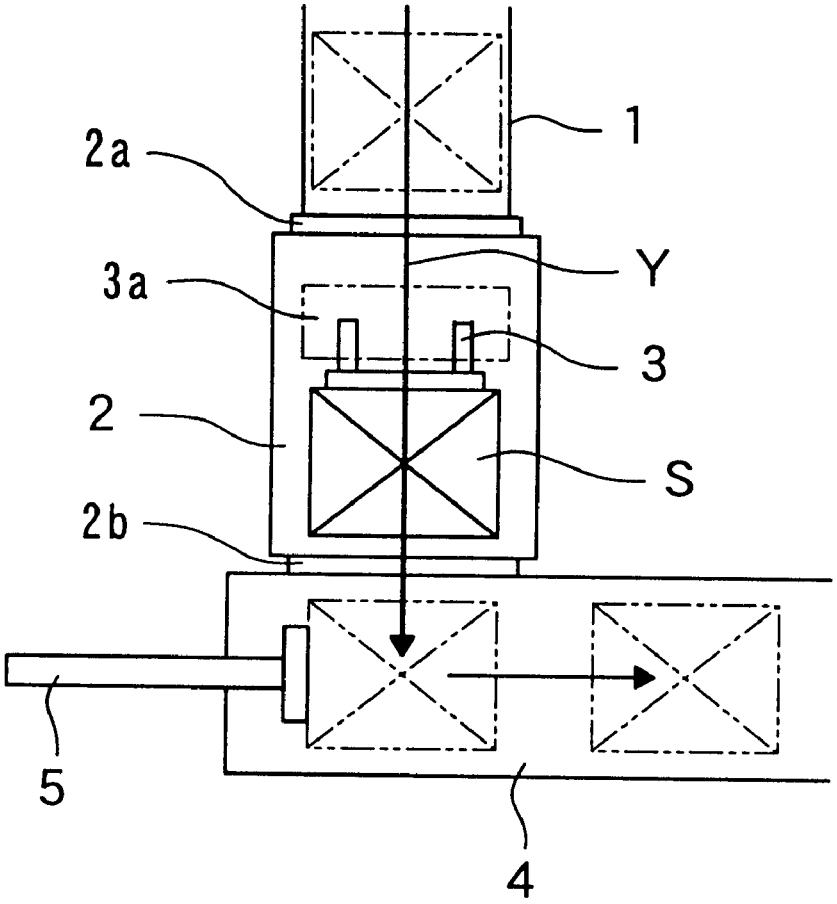
FIG. 1 is a plan view showing an embodiment of the material feeding mechanism in association with a continuous sintering apparatus of the present invention.
Figure 2:
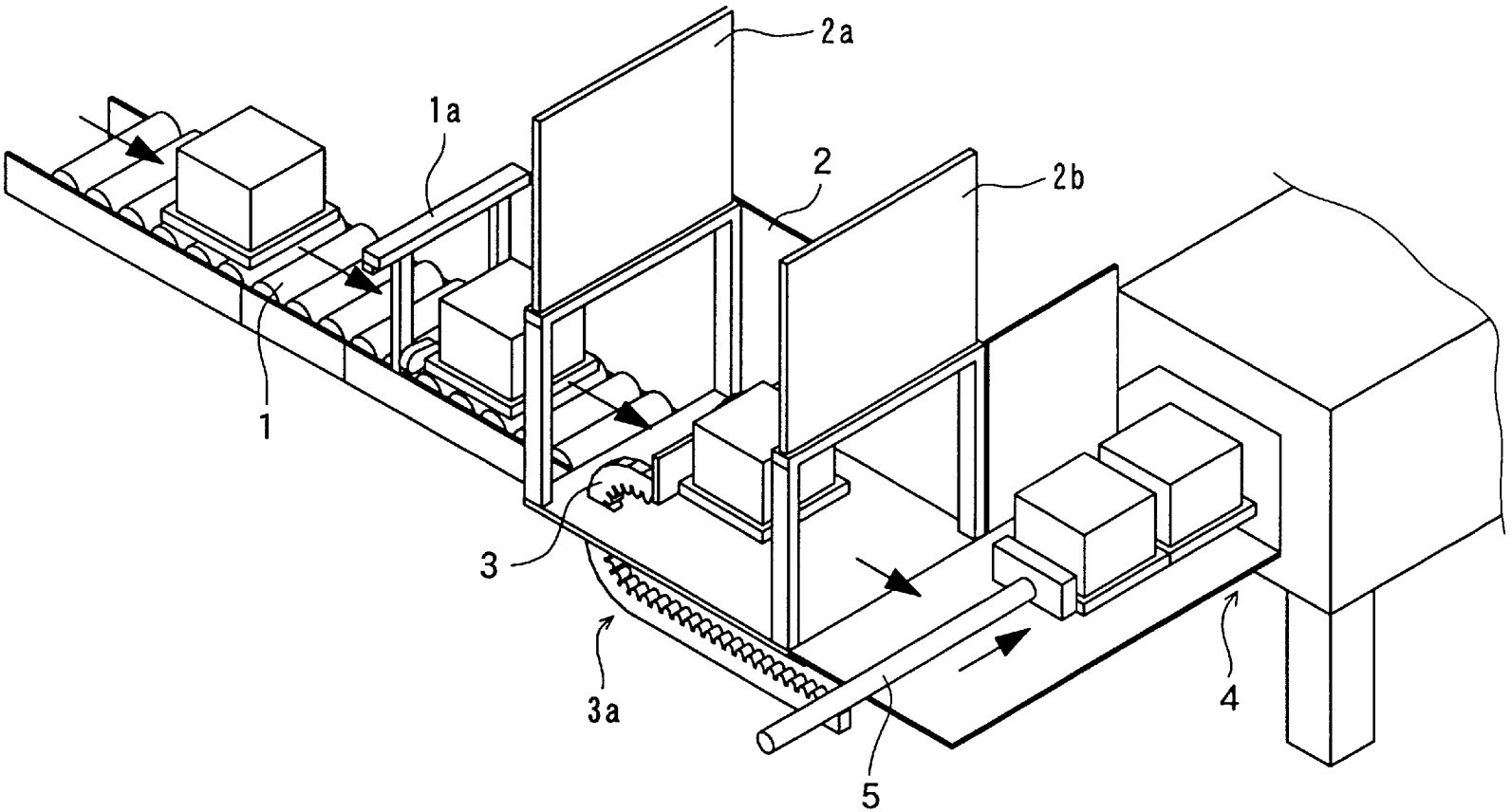
FIG. 2 is a perspective view of the embodiment shown in FIG. 1.
Figure 5:
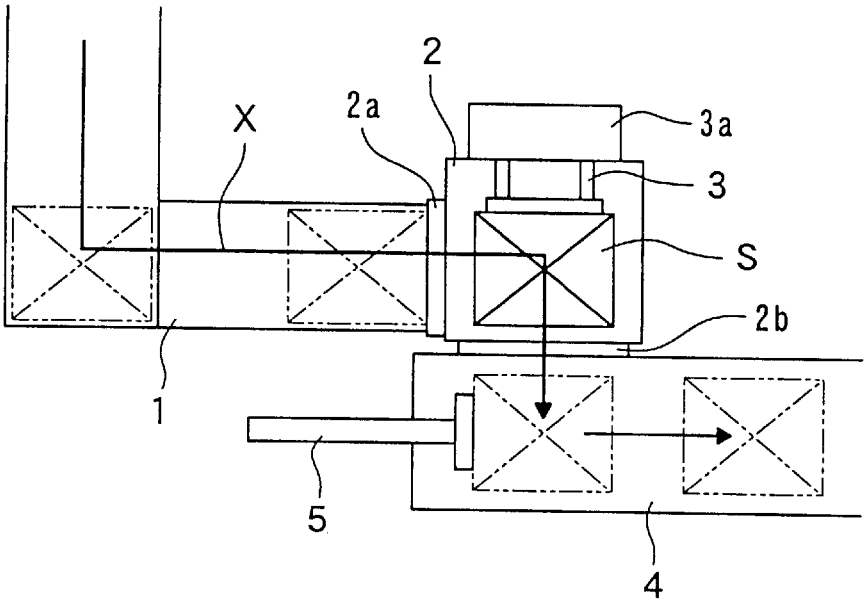
FIG. 5 (PRIOR ART)
FIG. 5 is a plan view showing an example of a prior art material feeding mechanism in association with a continuous sintering apparatus.

Referring now to the embodiments shown in the drawings, the present invention will be further illustrated. FIG. 1 is a plan view showing an embodiment of the material feeding mechanism in association with the continuous sintering apparatus of the present invention, and FIG. 2 is a perspective view thereof. The same parts as in the prior art material feeding mechanism as shown in FIG. 5 are designated by the same reference numerals and not described hereinbelow.

In the material feeding mechanism of the present invention as shown in FIG. 1 and FIG. 2, the transporting 4 conveyor 1, the atmosphere-displacement chamber 2, and the loading pusher 3 are arranged in such a manner that the direction in which the material S is carried into the atmosphere-displacement chamber 2 by the transporting conveyor 1 and the direction in which the material S is fed from the atmosphere-displacement chamber 2 into the furnace casing 4 by the loading pusher 3 are linearly aligned as shown by the arrow Y (FIG. 1).

In addition, the loading pusher 3 and the drive unit 3*a* thereof are installed under a floor of the atmosphere-displacement chamber so that the loading pusher 3 moves up over the surface of the floor of the atmosphere-displacement chamber and moves forward and backward on the floor surface of the atmosphere-displacement chamber when the material S is fed into the furnace casing.

The feeding operation by the material feeding mechanism of such a construction as described above is made in the steps of:

(1) opening the entrance door 2*a* of the atmosphere-displacement chamber, (2) carrying the material S on the transporting conveyor 1 into the atmosphere-displacement chamber 2 by using the carrying pusher 1*a* (FIG. 2), (3) restoring the carrying pusher 1*a,*
(4) closing the entrance door 2*a* of the atmosphere-displacement chamber,
(5) displacing or replacing the atmosphere of the atmosphere-displacement chamber 2 by the furnace atmosphere,
(6) opening the exit door 2*b* of the atmosphere-displacement chamber,
(7) carrying the material S into the furnace casing 4 by the loading pusher 3,
(8) restoring the loading pusher 3,
(9) closing the exit door 2*b* of the atmosphere-displacement chamber, and
(10) feeding the material S to the predetermined location in the furnace casing by using the main pusher 5.

Figure 3A:
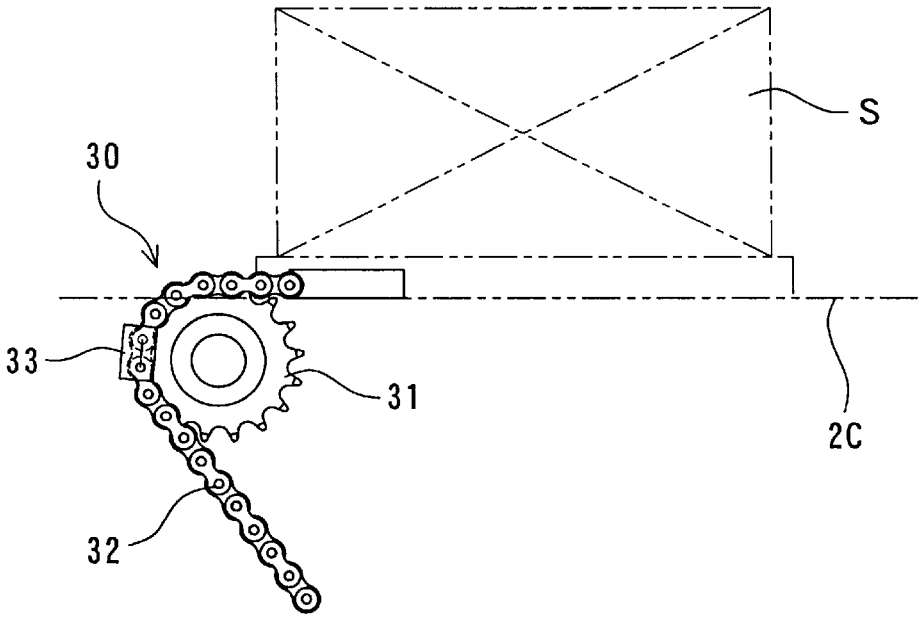
FIGS. 3A and 3B are explanatory drawings showing a chain pusher preferably used as a loading pusher in the present invention.
Figure 3B:
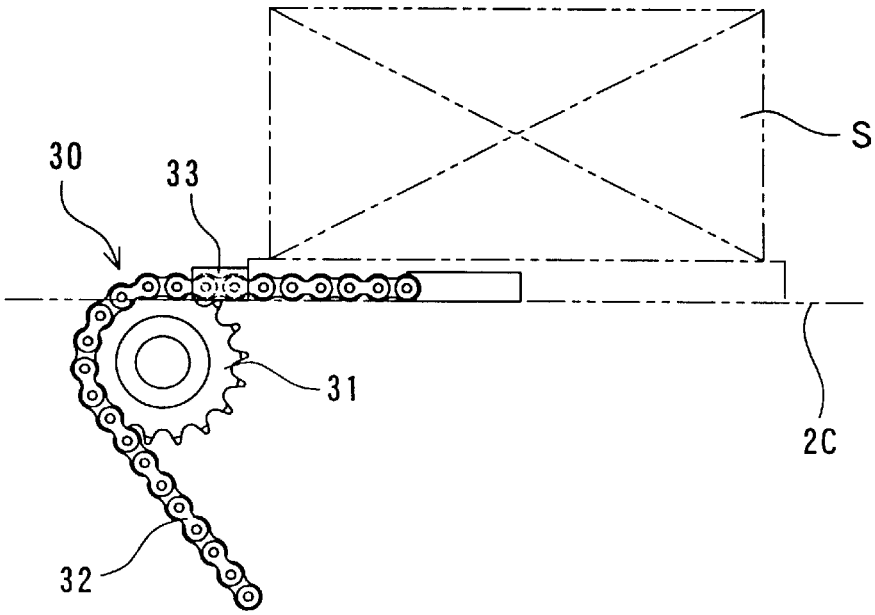
Figure 4:
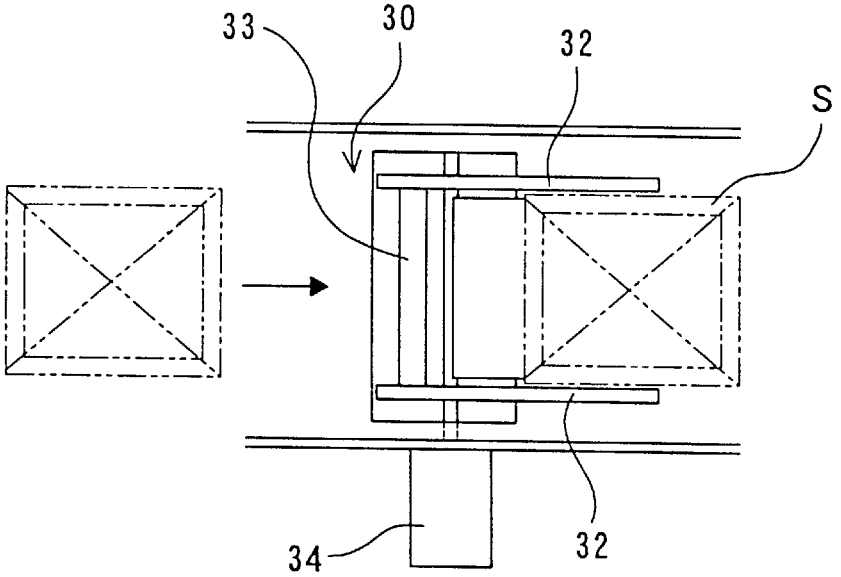
FIG. 4 is a plan view of the chain pusher.

In the present invention, the chain pusher 30 as shown in FIGS. 3A, 3B and 4 can preferably be used as a loading pusher 3. As seen from FIGS. 3A and 3B, the chain pusher 30 comprises a sprocket 31 disposed under the floor surface 2*c* of the atmosphere-displacement chamber, a chain 32 rotating via the sprocket, and a pusher head 33 mounted at the predetermined position on the chain. The sprocket 31 can be rotated by the drive motor 34 (See FIG. 4).

FIG. 3A shows a state in which the pusher head 33 is stored under the floor surface 2*c* of the atmosphere-displacement chamber, and the material S is carried into the atmosphere-displacement chamber 2 by the carrying pusher 1*a* in this state. When the material S is carried into the atmosphere-displacement chamber 2, as shown in FIG. 3B, the chain 32 rotates by the rotation of the sprocket 31, and in association with it, the pusher head 33 moves up over the floor surface 2*c* of the atmosphere-displacement chamber. By further rotating the chain 32 by rotating the sprocket 31 in this state, the pusher head 33 slides forward on the floor surface 2*c* of the atmosphere-displacement chamber, and pushes and feeds the material S into the furnace casing. After the material S is pushed out from the atmosphere-displacement chamber 2, the sprocket 31 is rotated in a reverse direction to move the pusher head 33 backward, and place it under the floor surface 2*c* of the atmosphere-displacement chamber into the waiting state as shown in FIG. 3A.

FIG. 4 is a plan view of the chain pusher 30 viewed from the top, and two chains 32 are disposed in parallel at a distance slightly wider than the width of the material S. The pusher head 33 is mounted on the near side from the tip of the chain in such a manner that it crosses between these two chains 32. In such a structure, the fed material S enters between both chains and the pusher head 33 can stably hold the material S.

As described above, in the material feeding mechanism in association with the continuous sintering apparatus of the present invention, the material is fed from the transporting conveyor via the atmosphere-displacement chamber to the furnace casing along the straight flow line. Therefore, in comparison with the prior art system in which the material is fed along the cranked flow line, the longitudinal dimensions of the portions in front and in the rear of the furnace casing do not have to be long enough. In addition, since the loading pusher and the drive unit thereof are installed under the floor of the atmosphere-displacement chamber, the material feeding mechanism can be miniaturized, and thus the flexibility in layout of apparatus in a plant is increased.

What is claimed is:

1. A material feeding mechanism in association with a continuous sintering apparatus for feeding a material from an atmosphere-displacement chamber into a furnace casing of a continuous sintering apparatus by using a loading pusher, said material being carried by a transporting conveyer into said atmosphere-displacement chamber, characterized in that the transporting conveyor, the atmosphere-displacement chamber, and the loading pusher are arranged in such a manner that a direction in which the material is carried into the atmosphere-displacement chamber by the transporting conveyor and a direction in which the material is fed from the atmosphere-displacement chamber into the furnace casing by the loading pusher are linearly aligned, and the loading pusher and a drive unit thereof are installed under a floor of the atmosphere-displacement chamber so that the loading pusher moves up over a surface of the floor of the atmosphere-displacement chamber and moves forward and backward on the floor surface of the atmosphere-displacement chamber when the material is fed into the furnace casing.

2. The material feeding mechanism according to claim 1, characterized in that said loading pusher comprises a chain pusher including a sprocket rotationally driven by a drive motor and disposed under the floor of the atmosphere-displacement chamber, a chain rotating via the sprocket, and a pusher head provided at the predetermined position on the chain, so that the pusher head moves up over the floor surface of the atmosphere-displacement chamber as the chain rotates, and moves forward and backward on the floor surface of the atmosphere-displacement chamber.

* * * * *